US010111308B2

(12) United States Patent
Huizenga et al.

(10) Patent No.: US 10,111,308 B2
(45) **Date of Patent: *Oct. 23, 2018**

(54) SYSTEM FOR AND METHOD OF COMMISSIONING LIGHTING DEVICES WITHIN A WIRELESS NETWORK

(71) Applicant: ABL IP Holding LLC, Atlanta, GA (US)

(72) Inventors: Charles Huizenga, Berkeley, CA (US); John Douglas Paton, Piedmont, CA (US); Zachary Smith, San Francisco, CA (US); Michael G. Corr, San Francisco, CA (US); Mahathi Sudini, Union City, CA (US); Peter Schmuckal, Redwood City, CA (US)

(73) Assignee: ABL IP Holding LLC, Atlanta, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/827,901

(22) Filed: Nov. 30, 2017

(65) Prior Publication Data

US 2018/0084628 A1 Mar. 22, 2018

Related U.S. Application Data

(63) Continuation of application No. 14/869,909, filed on Sep. 29, 2015, now Pat. No. 9,888,548, which is a (Continued)

(51) Int. Cl.
*H05B 37/02* (2006.01)
*H05B 33/08* (2006.01)

(52) U.S. Cl.
CPC ..... *H05B 37/0272* (2013.01); *H05B 33/0845* (2013.01); *H05B 37/02* (2013.01); *H05B 37/0227* (2013.01)

(58) Field of Classification Search
CPC ..... H05B 37/02; H05B 37/0209; H05B 37/0227; H05B 37/0245; H05B 37/0272
See application file for complete search history.

(56) References Cited

U.S. PATENT DOCUMENTS 3,598,994 A 8/1971 Markle et al.
3,733,528 A 5/1973 Gilbreath
(Continued)

OTHER PUBLICATIONS

Adams, J. T., "Wireless Sensors and Controls Make the Organic Building," May 2006, Proceedings of the 2006 IEEE Intl. Symposium on Electronics and the Environment, pp. 109-113.
(Continued)

*Primary Examiner* — Jason Crawford
(74) *Attorney, Agent, or Firm* — Carr & Ferrell LLP

(57) ABSTRACT

A lighting system for and method of commissioning LED light fixtures is disclosed. The LED light fixtures include a controller unit that is programed with lighting firmware and an on-board 5 light sensor that is responsive to visible light signals from a light source. In operation, the light sensor is irradiated visible light signals and/or visible light sequences that instruct the LED light fixture via the controller unit to join a group, be locked into a group, run lighting programs and/or become un-locked from a group.

24 Claims, 4 Drawing Sheets

Related U.S. Application Data continuation of application No. 13/694,455, filed on Dec. 4, 2012, now Pat. No. 9,192,019.

(60) Provisional application No. 61/567,633, filed on Dec. 7, 2011.

(56) References Cited

U.S. PATENT DOCUMENTS

| | | | |
|---|---|---|---|
| 3,735,141 | A | 5/1973 | Beling |
| 4,242,614 | A | 12/1980 | Vatis et al. |
| 4,323,820 | A | 4/1982 | Teich |
| 4,347,461 | A | 8/1982 | Carlson |
| 4,355,309 | A | 10/1982 | Hughey et al. |
| 4,358,717 | A | 11/1982 | Elliott |
| 4,388,567 | A | 6/1983 | Yamazaki et al. |
| 4,454,509 | A | 6/1984 | Buennagel et al. |
| 4,686,380 | A | 8/1987 | Angott |
| 4,797,599 | A | 1/1989 | Ference et al. |
| 4,889,999 | A | 12/1989 | Rowen |
| 5,005,211 | A | 4/1991 | Yuhasz |
| 5,025,248 | A | 6/1991 | Bergeron |
| 5,061,997 | A | 10/1991 | Rea et al. |
| 5,146,153 | A | 9/1992 | Luchaco et al. |
| 5,154,504 | A | 10/1992 | Helal et al. |
| 5,237,264 | A | 8/1993 | Moeley et al. |
| 5,248,919 | A | 9/1993 | Hanna et al. |
| 5,268,631 | A | 12/1993 | Gorman et al. |
| 5,357,170 | A | 10/1994 | Luchaco et al. |
| 5,373,453 | A | 12/1994 | Bae |
| 5,471,063 | A | 11/1995 | Hayes et al. |
| 5,561,351 | A | 10/1996 | Vrionis et al. |
| 5,572,438 | A | 11/1996 | Ehlers et al. |
| 5,637,930 | A | 6/1997 | Rowen et al. |
| 5,659,289 | A | 8/1997 | Zonkoski et al. |
| 5,770,926 | A | 6/1998 | Choi et al. |
| 5,774,052 | A | 6/1998 | Hamm et al. |
| 5,818,128 | A | 10/1998 | Hoffman et al. |
| 5,822,012 | A | 10/1998 | Jeon et al. |
| 5,872,429 | A | 2/1999 | Xia et al. |
| 5,904,621 | A | 5/1999 | Small et al. |
| 5,905,442 | A | 5/1999 | Mosebrook et al. |
| 5,909,087 | A | 6/1999 | Bryde et al. |
| 5,927,603 | A | 7/1999 | McNabb |
| 5,962,989 | A | 10/1999 | Baker |
| 5,982,103 | A | 11/1999 | Mosebrook et al. |
| 6,025,783 | A | 2/2000 | Steffens, Jr. |
| 6,044,062 | A | 3/2000 | Brownrigg et al. |
| 6,100,653 | A | 8/2000 | Lovell et al. |
| 6,108,614 | A | 8/2000 | Lincoln et al. |
| 6,148,306 | A | 11/2000 | Seidl et al. |
| 6,169,377 | B1 | 1/2001 | Bryde et al. |
| 6,175,860 | B1 | 1/2001 | Gaucher |
| 6,184,622 | B1 | 2/2001 | Lovell et al. |
| 6,249,516 | B1 | 6/2001 | Brownrigg et al. |
| 6,252,358 | B1 | 6/2001 | Xydis et al. |
| 6,297,724 | B1 | 10/2001 | Bryans et al. |
| 6,300,727 | B1 | 10/2001 | Bryde et al. |
| 6,301,674 | B1 | 10/2001 | Saito et al. |
| 6,311,105 | B1 | 10/2001 | Budike |
| 6,323,781 | B1 | 11/2001 | Hutchison |
| 6,388,399 | B1 | 5/2002 | Eckel et al. |
| 6,400,280 | B1 | 6/2002 | Osakabe |
| 6,439,743 | B1 | 8/2002 | Hutchison |
| 6,441,750 | B1 | 8/2002 | Hutchison |
| 6,450,662 | B1 | 9/2002 | Hutchison |
| 6,473,002 | B1 | 10/2002 | Hutchison |
| 6,474,839 | B1 | 11/2002 | Hutchison |
| 6,504,266 | B1 | 1/2003 | Ervin |
| 6,510,369 | B1 | 1/2003 | Lacy |
| 6,527,422 | B1 | 3/2003 | Hutchison |
| 6,535,859 | B1 | 3/2003 | Yablonowski |
| 6,548,967 | B1 | 4/2003 | Dowling et al. |
| 6,614,358 | B1 | 9/2003 | Hutchison et al. |
| 6,633,823 | B2 | 10/2003 | Bartone et al. |
| 6,640,142 | B1 | 10/2003 | Wong et al. |
| 6,676,831 | B2 | 1/2004 | Wolfe |
| 6,689,050 | B1 | 2/2004 | Beutter et al. |
| 6,700,334 | B2 | 3/2004 | Weng |
| 6,775,588 | B1 | 8/2004 | Peck |
| 6,791,606 | B1 | 9/2004 | Miyano |
| 6,803,728 | B2 | 10/2004 | Balasubramaniam |
| 6,891,838 | B1 | 5/2005 | Petite et al. |
| 6,904,385 | B1 | 6/2005 | Budike, Jr. |
| 6,914,395 | B2 | 7/2005 | Yamauchi et al. |
| 6,914,893 | B2 | 7/2005 | Petite |
| 6,927,546 | B2 | 8/2005 | Adamson et al. |
| 6,990,394 | B2 | 1/2006 | Pastemak |
| 7,006,768 | B1 | 2/2006 | Franklin |
| 7,039,532 | B2 | 5/2006 | Hunter |
| 7,042,170 | B2 | 5/2006 | Vakil et al. |
| 7,045,968 | B1 | 5/2006 | Bierman et al. |
| 7,054,271 | B2 | 5/2006 | Brownrigg et al. |
| 7,079,808 | B2 | 7/2006 | Striemer |
| 7,103,511 | B2 | 9/2006 | Petite |
| 7,167,777 | B2 | 1/2007 | Budike, Jr. |
| 7,199,530 | B2 | 4/2007 | Vakil et al. |
| 7,202,613 | B2 | 4/2007 | Morgan et al. |
| 7,221,110 | B2 | 5/2007 | Sears et al. |
| 7,233,080 | B2 | 6/2007 | Gamault et al. |
| 7,263,073 | B2 | 8/2007 | Petite et al. |
| 7,274,975 | B2 | 9/2007 | Miller |
| 7,307,389 | B2 | 12/2007 | Vakil et al. |
| 7,307,542 | B1 | 12/2007 | Chandler et al. |
| 7,333,880 | B2 | 2/2008 | Brewster et al. |
| 7,339,466 | B2 | 3/2008 | Mansfield |
| 7,346,433 | B2 | 3/2008 | Budike |
| 7,349,766 | B2 | 3/2008 | Rodgers |
| 7,352,972 | B2 | 4/2008 | Franklin |
| 7,354,175 | B2 | 4/2008 | Culbert et al. |
| 7,356,308 | B2 | 4/2008 | Hamada et al. |
| 7,369,060 | B2 | 5/2008 | Veskovic et al. |
| 7,400,226 | B2 | 7/2008 | Barrieau et al. |
| 7,417,556 | B2 | 8/2008 | Ling |
| 7,432,803 | B2 | 10/2008 | Fails et al. |
| 7,446,671 | B2 | 11/2008 | Giannopoulos et al. |
| 7,490,957 | B2 | 2/2009 | Leong et al. |
| 7,491,111 | B2 | 2/2009 | Ghaly |
| 7,528,503 | B2 | 5/2009 | Rognli et al. |
| 7,550,931 | B2 | 6/2009 | Lys et al. |
| 7,561,977 | B2 | 7/2009 | Horst et al. |
| 7,565,227 | B2 | 7/2009 | Richard et al. |
| 7,571,063 | B2 | 8/2009 | Howell et al. |
| 7,599,764 | B2 | 10/2009 | Matsuura et al. |
| 7,606,639 | B2 | 10/2009 | Miyaji |
| 7,623,042 | B2 | 11/2009 | Huizenga |
| 7,650,425 | B2 | 1/2010 | Davis et al. |
| 7,659,674 | B2 | 2/2010 | Mueller et al. |
| 7,677,753 | B1 | 3/2010 | Wills |
| 7,697,927 | B1 | 4/2010 | Owens |
| 7,706,928 | B1 | 4/2010 | Howell et al. |
| 7,719,440 | B2 | 5/2010 | Delp et al. |
| 7,755,505 | B2 | 7/2010 | Johnson et al. |
| 7,760,068 | B2 | 7/2010 | Hatemata et al. |
| 7,783,188 | B2 | 8/2010 | Clark |
| 7,812,543 | B2 | 10/2010 | Budike, Jr. |
| 7,839,017 | B2 | 11/2010 | Huizenga et al. |
| 7,843,353 | B2 | 11/2010 | Pan et al. |
| 7,860,495 | B2 | 12/2010 | McFarland |
| 7,880,394 | B2 | 2/2011 | Sibalich et al. |
| 7,884,732 | B2 | 2/2011 | Huizenga |
| 7,889,051 | B1 | 2/2011 | Billig et al. |
| 7,902,759 | B2 | 3/2011 | Newman, Jr. |
| 7,925,384 | B2 | 4/2011 | Huizenga |
| 7,962,054 | B2 | 6/2011 | Nakazato et al. |
| 8,033,686 | B2 | 10/2011 | Recker et al. |
| 8,214,061 | B2 | 7/2012 | Westrick, Jr. et al. |
| 8,275,471 | B2 | 9/2012 | Huizenga et al. |
| 8,344,665 | B2 | 1/2013 | Verfuerth et al. |
| 8,364,325 | B2 | 1/2013 | Huizenga et al. |
| 8,571,904 | B2 | 10/2013 | Guru et al. |
| 8,575,861 | B1 | 11/2013 | Gordin |
| 8,588,830 | B2 | 11/2013 | Myer et al. |
| 8,755,915 | B2 | 6/2014 | Huizenga et al. |
| 8,854,208 | B2 | 10/2014 | Huizenga et al. |

(56) References Cited

U.S. PATENT DOCUMENTS 9,192,019 B2* 11/2015 Huizenga ..... H05B 37/02
9,664,814 B2 5/2017 Huizenga et al.
9,888,548 B2* 2/2018 Huizenga ..... H05B 37/0272
2001/0015409 A1 8/2001 Mahler et al.
2001/0025349 A1 9/2001 Sharood et al.
2002/0009978 A1 1/2002 Dukach et al.
2002/0043938 A1* 4/2002 Lys ..... H04L 29/12254 315/149
2002/0080027 A1 6/2002 Conley, III
2002/0143421 A1 10/2002 Wetzer
2002/0175815 A1 11/2002 Baldwin
2003/0015973 A1 1/2003 Ovens et al.
2003/0020595 A1 1/2003 Wacyk
2003/0034284 A1 2/2003 Wolfe
2003/0058350 A1 3/2003 Ishimaru et al.
2003/0109938 A1 6/2003 Daum et al.
2003/0154044 A1 8/2003 Lundstedt et al.
2003/0209999 A1 11/2003 Hui et al.
2004/0002792 A1 1/2004 Hoffknecht
2004/0051467 A1 3/2004 Balasubramaniam
2004/0090787 A1 5/2004 Dowling et al.
2004/0100394 A1 5/2004 Hitt
2004/0130909 A1 7/2004 Mueller et al.
2004/0153207 A1 8/2004 Peck
2005/0017922 A1 1/2005 Devos et al.
2005/0030203 A1 2/2005 Sharp et al.
2005/0043862 A1 2/2005 Brickfield et al.
2005/0090915 A1 4/2005 Geiwitz
2005/0099319 A1 5/2005 Hutchison et al.
2005/0234600 A1 10/2005 Boucher et al.
2006/0001950 A1 1/2006 Fujimura et al.
2006/0044152 A1 3/2006 Wang
2006/0125426 A1* 6/2006 Veskovic ..... H05B 37/0254 315/312
2006/0142900 A1 6/2006 Rothman et al.
2006/0159336 A1 7/2006 Uezono
2006/0161270 A1 7/2006 Luskin et al.
2006/0215345 A1 9/2006 Huizenga
2006/0244624 A1 11/2006 Wang et al.
2006/0245360 A1 11/2006 Ensor et al.
2006/0291136 A1 12/2006 Okishima
2007/0005195 A1 1/2007 Pasquale et al.
2007/0013489 A1 1/2007 Bechtle et al.
2007/0024708 A1 2/2007 Lin et al.
2007/0057807 A1 3/2007 Walters et al.
2007/0085700 A1 4/2007 Walters et al.
2007/0090960 A1 4/2007 Miki
2007/0229250 A1 10/2007 Recker et al.
2007/0237195 A1 10/2007 Sekigawa
2007/0271006 A1 11/2007 Golden et al.
2007/0273290 A1 11/2007 Ashdown et al.
2007/0273307 A1 11/2007 Westrick et al.
2007/0276547 A1 11/2007 Miller
2007/0291483 A1 12/2007 Lys
2008/0071391 A1 3/2008 Busby et al.
2008/0075476 A1 3/2008 Nakazato et al.
2008/0133065 A1 6/2008 Cannon et al.
2008/0167756 A1 7/2008 Golden et al.
2008/0183307 A1 7/2008 Clayton et al.
2008/0231464 A1* 9/2008 Lewis ..... H05B 37/0272 340/5.74
2008/0242314 A1 10/2008 McFarland
2008/0258633 A1 10/2008 Voysey
2008/0265799 A1 10/2008 Sibert
2008/0281473 A1 11/2008 Pitt
2009/0018706 A1 1/2009 Wittner
2009/0026966 A1 1/2009 Budde et al.
2009/0045941 A1 2/2009 Cooper
2009/0048691 A1 2/2009 Donaldson
2009/0055032 A1 2/2009 Rodgers
2009/0058193 A1 3/2009 Reid et al.
2009/0063257 A1 3/2009 Zak et al.
2009/0066473 A1 3/2009 Simons
2009/0072945 A1 3/2009 Pan et al.
2009/0132070 A1 5/2009 Ebrom et al.
2009/0174866 A1 7/2009 Okada
2009/0198384 A1 8/2009 Ahn
2009/0204232 A1 8/2009 Guru et al.
2009/0218951 A1 9/2009 Weaver
2009/0222223 A1 9/2009 Walters et al.
2009/0236910 A1* 9/2009 Yamada ..... G08C 23/04 307/40
2009/0240381 A1 9/2009 Lane
2009/0243517 A1 10/2009 Verfuerth et al.
2009/0248217 A1 10/2009 Verfuerth et al.
2009/0261735 A1 10/2009 Sibalich et al.
2009/0262189 A1 10/2009 Marman
2009/0267540 A1 10/2009 Chemel et al.
2009/0278472 A1 11/2009 Mills et al.
2009/0278934 A1 11/2009 Ecker et al.
2009/0292402 A1 11/2009 Cruickshank
2009/0292403 A1 11/2009 Howell et al.
2009/0299527 A1 12/2009 Huizenga et al.
2009/0315485 A1 12/2009 Verfuerth et al.
2010/0008676 A1 1/2010 Kojima et al.
2010/0039240 A1 2/2010 Rodriguez et al.
2010/0052939 A1 3/2010 Liang
2010/0066267 A1* 3/2010 Meyer ..... H05B 37/0272 315/294
2010/0114340 A1* 5/2010 Huizenga ..... H05B 37/0272 700/90
2010/0134019 A1 6/2010 Berhorst
2010/0134051 A1 6/2010 Huizenga et al.
2010/0141153 A1 6/2010 Recker et al.
2010/0164386 A1 7/2010 You
2010/0179670 A1 7/2010 Forbes et al.
2010/0185339 A1 7/2010 Huizenga et al.
2010/0191388 A1 7/2010 Huizenga et al.
2010/0201203 A1 8/2010 Schatz et al.
2010/0204847 A1 8/2010 Leete et al.
2010/0207548 A1 8/2010 Iott
2010/0237783 A1 9/2010 Dupre et al.
2010/0262296 A1 10/2010 Davis et al.
2010/0265100 A1 10/2010 Jalbout et al.
2010/0327766 A1 12/2010 Recker et al.
2011/0006877 A1 1/2011 Franklin
2011/0012541 A1 1/2011 Finch
2011/0029136 A1 2/2011 Altonen et al.
2011/0043035 A1* 2/2011 Yamada ..... H02J 3/14 307/39
2011/0043052 A1 2/2011 Huizenga et al.
2011/0101871 A1 5/2011 Schenk et al.
2011/0109424 A1 5/2011 Huizenga et al.
2011/0112702 A1 5/2011 Huizenga et al.
2011/0121654 A1 5/2011 Recker et al.
2011/0133655 A1 6/2011 Recker et al.
2011/0175533 A1 7/2011 Holman et al.
2011/0206393 A1 8/2011 Nakazato et al.
2012/0001548 A1 1/2012 Recker et al.
2012/0004739 A1 1/2012 Sato et al.
2012/0020060 A1 1/2012 Myer et al.
2012/0025717 A1* 2/2012 Klusmann ..... H05B 37/0218 315/152
2012/0026726 A1 2/2012 Recker et al.
2012/0043889 A1 2/2012 Recker et al.
2012/0074843 A1 3/2012 Recker et al.
2012/0080944 A1 4/2012 Recker et al.
2012/0098432 A1 4/2012 Recker et al.
2012/0098436 A1* 4/2012 Talstra ..... H04B 10/1149 315/132
2012/0098439 A1 4/2012 Recker et al.
2012/0098655 A1 4/2012 Preta et al.
2012/0143383 A1 6/2012 Cooperrider et al.
2012/0330476 A1 12/2012 Huizenga et al.
2013/0009036 A1* 1/2013 Yianni ..... G08C 23/04 250/206
2013/0033183 A1 2/2013 Verfuerth et al.
2013/0103201 A1 4/2013 Huizenga et al.
2013/0113291 A1 5/2013 Recker et al.
2013/0131882 A1 5/2013 Verfuerth et al.
2013/0147366 A1 6/2013 Huizenga et al.
2013/0193847 A1 8/2013 Recker et al.

(56) References Cited

U.S. PATENT DOCUMENTS

| | | | | |
|---|---|---|---|---|
| 2013/0221858 | A1* | 8/2013 | Silberstein | H05B 37/0272 315/153 |
| 2013/0285558 | A1 | 10/2013 | Recker et al. | |
| 2014/0265878 | A1 | 9/2014 | Gritti | |
| 2014/0354995 | A1 | 12/2014 | Huizenga et al. | |
| 2016/0021723 | A1 | 1/2016 | Huizenga et al. | |

OTHER PUBLICATIONS

Canovas, S. R., Chermont, M.G., and Cugnasaca, C.E, "Remote Monitoring and Actuation Based on LonWorks Technology," Jul. 2005, 2005 EFITA/WCCA Joint Congress on IT in Agriculture, pp. 812-819.

Gislason, D. and Gillman, T. "ZigBee Wireless Sensor Networks," Nov. 2004, Dr. Dobbs online journal, www.ddj.com/184405887, 4 pages.

Gutierrez, J. A., "On the Use of IEEE Std. 802, 15.4 to enable Wireless Sensor Networks in Building Automation," Dec. 2007, Int'l. Journal of Wireless Information Network, vol. 14, No. 4, pp. 295-301.

Kintner-Meyer, M. "Opportunities of Wireless Sensors and Controls for Building Operations," Aug.-Sep. 2005, Energy Engineering, vol. 102, No. 5, pp. 27-48.

Motegi, N., Piette, M., Kinney, S., and Herter, K., "Web-Based Energy Information Systems for Energy Management and Demand Response in Commercial Buildings," Apr. 2003, Lawrence Berkeley National Laboratory, 75 pages.

Park, H., Burke, J., and Srivastava, M., "Design and Implementation of a Wireless Sensor Network for Intelligent Light Control," Apr. 2007, IPSN 07, pp. 370-379.

Sandhu, J. S., Agogino, A. M., and Agogino, A. K., "Wireless Sensor Networks for Commercial Lighting Control: Decision Making with Multi-Agent Systems," 2004, American Association for Artificial Intelligence, 5 pages.

Sandhu, J. S. S., Agogino, A. M., "Wireless Sensor Networks for Commercial Lighting Control: Decision Making with Multi-Agent Systems," Jul. 2004, Workshop on Sensor Networks, 19 pages.

Sekinger, J., "Wireless Lighting Control Technology," Oct. 2005, Phillips NAESCO Midwest Regional Mtgs., 30 pages.

Singhvi, V., Krause, A., Guestrin, C., Garrett, J. H., Matthews, H. S. "Intelligent Light Control Usine Sensor Networks," Nov. 2005, SenSys, 12 pages.

Teasdale, D., Rubinstein, F., Watson, D., and Purdy, S., "Annual Technical Progress Report: Adapting Wireless Technology to Lighting Control and Environmental Sensing," Oct. 2005, Dust Networks, Annual Technical Progress Report, 41 pages.

Wang, D., Arens, E., and Federspiel, C., "Opportunities to Same Energy and Improve Comfort by Using Wireless Sensor Networks in Buildings," Oct. 2003, Proceedings of the third intl Conference for Enhanced Building Operations, 6 pages.

* cited by examiner

SYSTEM FOR AND METHOD OF COMMISSIONING LIGHTING DEVICES WITHIN A WIRELESS NETWORK

RELATED APPLICATIONS

The present application is a continuation of, and claims the benefit of U.S. non-provisional patent application Ser. No. 14/869,909 filed on Sep. 29, 2015, now U.S. Pat. No. 9,888,548, issued on Feb. 6, 2018, which is a continuation of U.S. non-provisional patent application Ser. No. 13/694,455 filed on Dec. 4, 2012, now U.S. Pat. No. 9,192,019, issued Nov. 17, 2015, which claims priority to U.S. provisional patent application Ser. No. 61/567,633, filed on Dec. 7, 2011, all of which are hereby incorporated by reference herein in their entireties including all references cited therein.

FIELD OF THE INVENTION

This invention relates to lighting systems. More specifically, this relates to controllers for controlling lighting and devices and methods for commissioning and programming the same.

BACKGROUND OF THE INVENTION

Wireless lighting control systems allow switches, lighting fixtures, motion sensors and light sensors, hereafter lighting devices, to be joined in groups and operate in a cooperative fashion to provide suitable lighting conditions based on any number of conditions. For example, lighting devices in a particular group are instructed to be cooperatively responsive to occupancy, ambient light, time of the day and power usage on a power grid, and operation of other lighting devices inside or outside of the group, to name a few. Lighting devices, or a portion of the lighting devices, within the wireless lighting control system are configured to initiate particular lighting sequences and/or run particular programs imbedded within their firmware. The process of grouping lighting devices within the wireless lighting control system to operate collectively in response to conditions, initiate particular lighting sequences and/or run particular programs, is referred to herein as commissioning.

The lighting devices in the wireless lighting control systems employ radio transmissions to provide communication signals between the lighting devices. The lighting devices, or a portion thereof, include a micro-processor coded with firmware that instructs one or more control circuits to operate the light fixtures within the wireless lighting control system to respond to one or more of the conditions, mentioned above.

While these wireless lighting control systems provide the flexibility to generate any number of lighting scenarios with reduced energy consumption and cost, commissioning of the lighting devices within a wireless lighting control system can be complicated. Typically, each of the lighting devices needs to be placed into a commissioning mode and then instructed to join a group and run particular program sequences. This is accomplished, for example, by executing a prescribed press and/or press and hold button sequence on each device. Typically, these sequences require the ability to access or touch a lighting fixture which will typically require the use of a ladder or other device to reach the fixture. In some more sophisticated wireless lighting control systems, lighting devices are capable of being commissioned remotely over a network. Regardless, these commissioning procedures are difficult for electricians or installers to perform properly. Accordingly, setting up a wireless lighting control system usually require that a specialized technician perform the commissioning of lighting devices after the wireless lighting control systems is installed by the electrician or installer. Wireless controls network typically require a separate master device to coordinate the network. This master device adds cost and complexity to the wireless network. Not requiring this master device greatly simplifies the installation and support of this network.

SUMMARY OF THE INVENTION

A lighting system of the present invention includes lighting devices that are grouped to cooperatively operate over a wireless network, or wireless lighting control network, in response to a condition. A wireless network, or wireless lighting control network, herein refers to the network or medium through which control signals and operational data are transmitted between the lighting devices, control devices, computers and/or servers. Typically, control signals and operational data is transmitted between the lighting devices, control devices, computers and/or servers using radio packet transmissions. Details of preferred wireless networks, or wireless lighting control networks are provided in U.S. patent application Ser. No. 12/156,621, filed Jun. 2, 2008 and titled "DISTRIBUTED INTELLIGENCE IN LIGHTING CONTROL," the contents of which is hereby incorporated by reference.

Lighting devices within the network generally include switches, light fixtures, motion detectors that control lighting levels in response to one or more conditions, such as occupancy detection, ambient light, occupant preference, automatic schedules that direct actions at a given time of the day and electrical utility signals and control signals transmitted from a control device. The process of "grouping" lighting devices to cooperatively operate in response to the one or more conditions, locking the lighting devices to cooperatively operate within a fixed group and/or initiating lighting devices to run lighting programs is referred to herein as commissioning.

The present invention provides a method of commissioning lighting devices that does not require the commissioning agent to physically touch the lighting device as would be required for pressing a button located on a lighting device or control device. The present is used to commission lighting device to join a group of lighting devices and cooperatively operate in response to a condition. The present invention is also used to create new groups and close groups of lighting device from a lighting device, such that the lighting devices cooperatively operate in response to a condition. Joining groups of lighting device, creating new groups of lighting device and closing groups of lighting device to cooperatively operate in response to a condition is also referred to herein as a process of commissioning lighting devices.

While the lighting devices are all configured to ultimately control lighting from light fixtures that are electrically coupled to a load circuit, not all of the lighting devices are necessary electrically coupled to, or powered by, a load circuit. For example, control devices, switches, motion sensors and other sensors within the network can be battery powered, solar powered and/or powered by any other suitable means. Details of a wireless sensor, for example, are provided in the U.S. patent application Ser. No. 12/940,902, filed Nov. 5, 2010 and titled "WIRELESS SENSOR," contents of which is hereby incorporated by reference.

In accordance with the method of the present invention commissioning lighting devices to join a group of light fixtures within a wireless network is accomplished by transmitting group information over the wireless network. The group information is transmitted over the wireless network by actuating a momentary switch on a lighting device within the wireless network or irradiating a light sensor on one or more of the lighting devices within the wireless network with a visible commissioning light signal, such as described in detail below. The group information is received by radio transceivers on the lighting devices within the wireless network. Once the group information is received by the lighting devices, irradiating light sensors on each of the lighting devices with a first visible commissioning light signal instructs or results in the lighting devices to join the group. Once the lighting device within the wireless network join the group, irradiating at least one of the light sensors on the lighting devices with a second visible light signal closes the group.

In accordance with the method of the present invention a group lighting devices is created within the network by irradiating a light sensor on one or more of the lighting device with a first visible commissioning light signal from a light source. The light sensor is electrically coupled to a micro-processor with a memory unit with firmware loaded thereon (also referred to herein as a control circuit). When the light sensor is irradiated with the first visible commissioning light signal, the micro-processor instructs the lighting device associated with the light sensor and control circuit to create a new group of lighting devices. The lighting device broadcasts a unique group code or group address for subsequent device to receive.

In accordance with the method of the present invention, additional lighting devices are commissioned within the network by irradiating a light sensor with a second visible commissioning light signal from a light source. The lighting device captures and stores the group code or group address. The group is then closed by irradiating a light sensor with a third visible commissioning light signal.

Regardless of how the group is selected or determined, then a light sensor of any group member is irradiated with a visible commissioning light signal from the light source to close the group. When the light sensor senses the close the group signal, the micro-processor then instructs the lighting device and its group members to close the group and commence operation as a group. The lighting device will then respond cooperatively to control commands, operational data and/or conditions of other lighting devices within the group. While all of the commissioning signals can have the same wavelength, preferably the light sensor is capable of differentiating and responding differently to light having different wavelengths.

The method of commissioning a lighting device described above is preferably performed on light fixtures. However, it will be clear to one skilled in the art from the description above and below that the present invention can also be used to commission other lighting devices within a wireless lighting control network including, but not limited to, switches, motion sensors, light sensors and control devices.

Where the lighting device is a light fixtures, in addition to the elements of a light sensor that is electrically coupled to a micro-processor with a memory unit with firmware loaded thereon, the light fixture also includes a driver circuit for powering a light engine and radio transducer. The light engine is a fluorescent light engine, an LED light engine or a combination thereof. The light sensor for commissioning a light fixture, the control circuit and the radio transducer, are collectively referred to, herein as the controller.

In accordance with the embodiments of the invention, the light sensor used to receive or detect the visible light commissioning signals, described above, measures and reports the spectral content of the visible light including reporting on narrower regions of the visible spectrum in portions of the spectrum generally described as red, green and blue. The light sensor may also be capable of calculating color temperature. Preferably, the light sensor is selectively responsive to mono-chromatic high intensity visible light commissioning signals. The information received from the light sensor may also be used by the controller to signal the light fixture increase or decrease the light emitted in response to ambient light levels.

A suitable light source for generating the visible commissioning light signals is a smart phone, an led light source and/or a laser light source. Preferably, the light source is highly portable and easily carried from lighting fixture to lighting fixture and is capable of generating a first visible commissioning light signal and the second visible commissioning light signals having different wavelengths. Most preferably, the light source is a high intensity light source that generates mono-chromatic light, such as dual-color hand-held laser. For example, a dual-color hand-held laser is configured to generate red light with a first laser source and green light with second laser source.

In accordance with yet further embodiments of the invention, the light source is configured to generate visible commissioning light sequences. The visible commissioning light sequences have any number of functions. However, preferably one or more visible commissioning light sequences are used to irradiate the light sensor and initiate a lighting program after the corresponding light fixture is instructed to join a group and before the light fixture is locked into the group. In addition, visible commissioning light sequences are used to irradiate the light sensor and initiate the micro-processor on the corresponding light fixture to un-locked the light fixture from the group, thus allowing the light fixture to be re-commissioned into a different group and/or instructed to run a lighting program, such as described above.

In yet further embodiments of the invention, the controller unit of the light fixture includes a momentary switch. During the setup process, this switch may be used to manually set the maximum light output of all of the lighting fixtures within the wireless group. When the group is being formed or has been reopened, the momentary switch may be pressed to initiate a set of commands to limit the output of all group members. During this process, each subsequent press or other command will reduce the maximum light output by a set increment on the immediate fixture and all group members. When the desired level is reached, the maximum light output can be set by initiating another command such as a press and hold command. This command sets the maximum level for the immediate fixture and all group members. When the lighting group is placed back into operational mode, the light output from the lighting fixtures will now not exceed the maximum setting. In the future, when new members join the group then this maximum level information will be shared with the new members of the group.

DETAILED DESCRIPTION OF THE INVENTION

Figure 1:
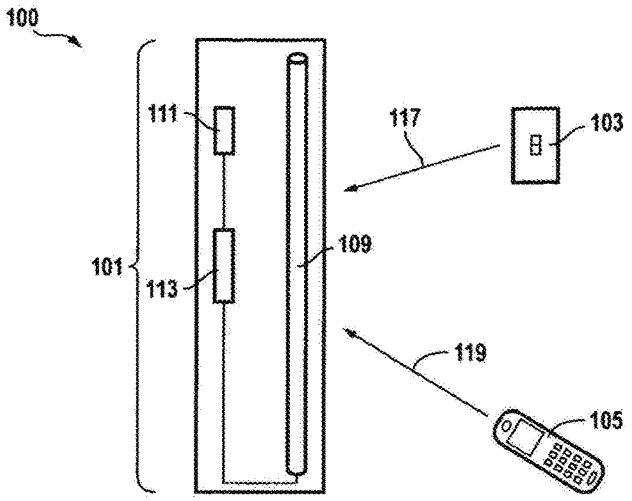
FIG. 1 shows schematic representation of a light fixture with a wireless controller for operating in a wireless lighting network, in accordance with the embodiments of the invention.

FIG. 1 shows schematic representation 100 of a light fixture 101 with a wireless controller 111 for operating in a wireless lighting network (not shown). The light fixture 101 also includes a driver circuit 113 for powering a light engine 109. Controller 111 and driver circuit 113 may be discrete devices or controller 111 may be embedded inside Controller 111. In operation controlling devices, such as a switch 103 or a hand-held remote 105 are configured to send out command signals, indicated by the arrows 117 and 119, respectively. Command signals instruct the light fixture 101 to turn on and off, to dim and/or run lighting programs. The wireless controller 111 includes a wireless radio transmitter and receiver (transducer) for communicating with the control devices 103 and 105 and for sending out operational data to other lighting devices (not shown) in the wireless lighting network. The controller 111 also includes a micro-processor and a memory unit loaded with firmware configured to execute the command signals from the control devices 103 and 105.

Figure 2:
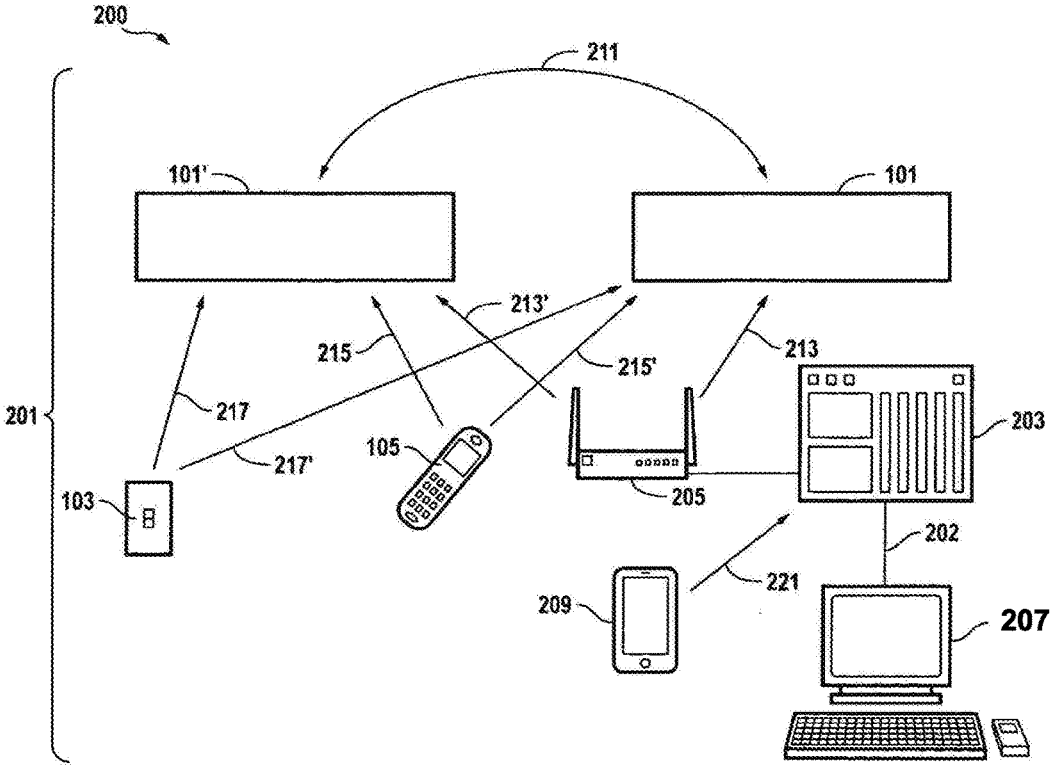
FIG. 2 shows a schematic representation of a wireless lighting network, in accordance with the embodiments of the invention.

FIG. 2 shows a schematic representation 200 of a wireless lighting network 201 with light fixtures 101 and 101' operating in a group over the wireless lighting network 201. The wireless lighting network 201 includes a gateway 205 and a server 203 capable of communicating with a number of lighting devices within the wireless lighting network 201. As described above, controlling devices, such as a switch 103 or a hand-held remote 105 are configured to send command signals, as indicated by the arrows 217/217' and 215/215' to control or commission the light fixtures 101 and 101'. Also, each of the light fixtures 101 and 101' includes a control circuit with micro-processor and memory unit with firmware for executing control signals as well a wireless radio transducer for communicating with the control devices 103 and 105 and for sending out operational data between each other and to the server 203 through the gateway 205, as indicated by the arrows 213 and 213'.

While the invention is described as operation within a wireless lighting network 201, it will be clear to one skilled in the art that a wireless lighting network 201 is not required to practice the invention. All control decision making resides within the firmware programmed into the wireless controller 111 including automatic schedules. The gateway 205 may be removed from the control system without interrupting or modifying automatic control of the lighting devices.

In operation, each of the lighting devices in the wireless lighting network 201 is capable of being mapped, displayed and controlled by a remote computer 207. History of operational data and other analytics of the operation of the wireless lighting network 201 and/or of each of the lighting devices within the wireless lighting network 201 is capable of being stored and displayed on the remote computer 207 over the server 203. Within the wireless lighting network 201 a cellular phone 209 is capable of being used as a control device. In operation the cellular phone 209 connects to the server 203 over a cellular network, as indicated by the arrow 221 and sends command signals from the cellular phone 209 to the server 203. The command signals are then transmitted to the light fixtures 101 and 101' or other lighting devices within the wireless lighting network 201 through the gateway 205.

Figure 3:
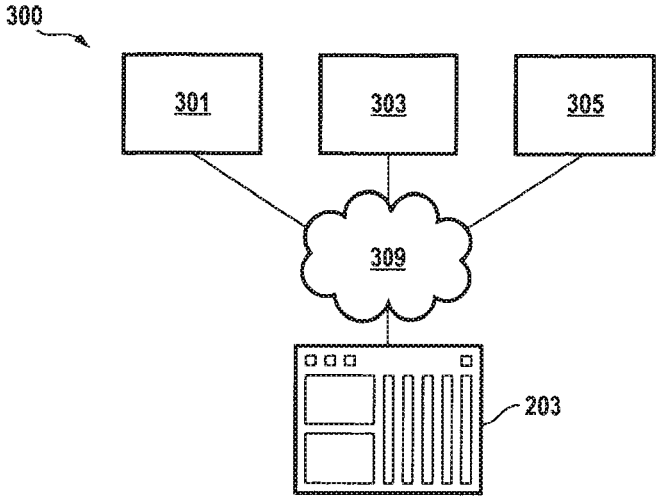
FIG. 3 shows a schematic representation of a wireless network for controlling groups or zones of lighting, in accordance with the embodiments of the invention.

FIG. 3 shows a schematic representation 300 of a wireless network for controlling groups or zones of lighting devices 301, 303 and 305. Each of the groups or zones of lighting devices, 301, 303 and 305 include lighting devices that have been commissioned to cooperatively operate in response to the one or more conditions within the group. Each of the groups or zones of lighting devices 301, 303 and 305 are preferably in communication with a server 203 over a network 309 that includes all of the necessary hardware configured to process communication protocols. Further details of lighting control networks and protocols are provided in U.S. patent application Ser. No. 12/156,621, filed Jun. 2, 2008 and titled "DISTRIBUTED INTELLIGENCE IN LIGHTING CONTROL," referenced previously.

Figure 4A:
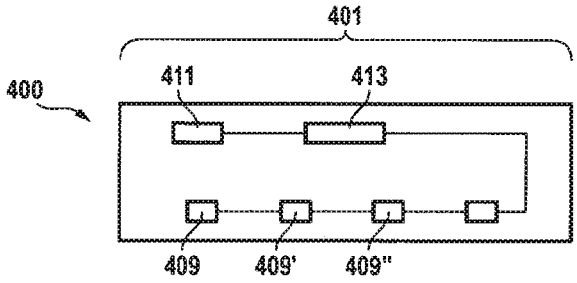
FIG. 4A shows schematic representation of an LED light fixture with a wireless controller for operating in a wireless lighting network, in accordance with the embodiments of the invention.

FIG. 4A shows schematic representation 400 of a light fixture 401, which is for example an LED light fixture 401 with a wireless controller 411 for operating in a wireless lighting network 201, such as described with reference to FIGS. 1-3. The controller 411 includes a radio transducer, a micro-processor and memory unit loaded with firmware, such as described above. The LED light fixture 401 also includes an LED driver circuit 413 for powering an LED light engine that includes any number of LEDs 409, 409' and 409". The LED driver circuit 413 provides power to the LED light engine based on command signals from control devices and/or other lighting device with a designated group of the wireless lighting network.

Figure 4B:
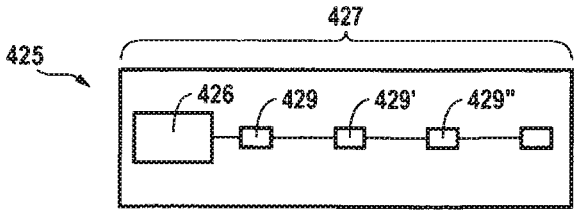
FIG. 4B shows schematic representation of an LED light fixture with a wireless controller unit that combines a controller circuit and driver circuit for operating in a wireless lighting network, in accordance with the embodiments of the invention.

FIG. 4B shows schematic representation 425 of an LED light fixture 427 with a wireless controller unit 426 for controlling and powering an LED light engine that includes LEDs 429, 429' and 429".

Figure 4C:
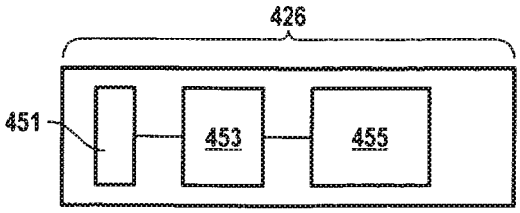
FIG. 4C shows a schematic representation of the wireless controller unit shown in FIG. 4B, in accordance with the embodiments of the invention.

Referring now to FIG. 4C, the controller unit 426 combines a controller circuit 453 and an LED driver circuit 455 into a single form factor. As described above, the controller circuit 453 includes a radio transducer, a micro-processor and memory unit loaded with firmware to run lighting programs or protocols, to execute control signals, to communicate operational data, to store usage history and/or perform any number of functions consistent with a wireless lighting control system. The controller unit 426 also includes an on-board sensor or commissioning module 451.

Figure 5A:
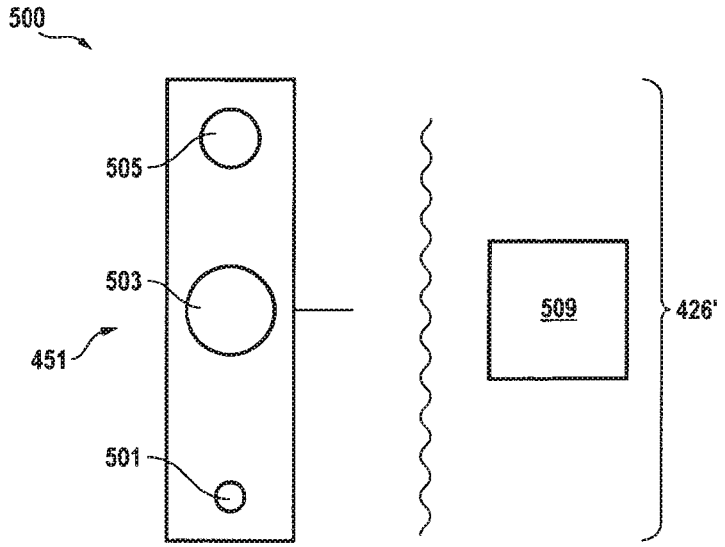
FIG. 5A shows schematic representation of a commissioning module for commissioning lighting devices within a wireless lighting network, in accordance with the embodiments of the invention.

FIG. 5A shows schematic representation 500 of the sensor or commissioning module 451 for commissioning one or more light fixtures 509 with one or more corresponding controller units 426'. In accordance with the embodiments of the invention the sensor or commissioning module 451 includes a light sensor 501, a motion sensor 503 a manual switch 505 and LED indicators. The motion sensor 503 is an infrared motion sensor, a ultrasonic motion sensor or any combination thereof. The motion sensor 503 is in communication with the one or more controller units 426' (FIG. 5A) and is configured to control the one or more lighting devices 509 based on detected motion.

Still referring to FIG. 5A, the sensor or commissioning module 451 also includes a manual switch 505. In operation when one or more lighting fixtures 509, such as one or more LED light fixtures 427 (FIG. 4B), is installed. Actuating the manual switch 505 instructs the micro-processor of the controller unit 426' to run firmware that allows the one or more lighting fixtures 509 to manually set the maximum light output of all of the lighting fixtures within the wireless group. When the group is being formed or has been reopened, the momentary switch may be pressed to initiate a set of commands to limit the output of all group members. During this process, each subsequent press or other command will reduce the maximum light output by a set increment on the immediate fixture and all group members. When the desired level is reached, the maximum light output can be set by initiating another command such as a press and hold command. This command sets the maximum level for the immediate fixture and all group members. When the lighting group is placed back into operational mode, the light output from the lighting fixtures will now not exceed the maximum setting. In the future, when new members join the group then this maximum level information will be shared with the new members of the group.

In an on-off dimming mode, the light fixtures 509 will power down to a dimmed level in the absence of detected motion by the motion sensor 503 for a first period of time or time delay. Then if no motion is detected by the motion sensor 503 for a second and longer period of time or time delay, the controller unit 426' powers the one or more lighting fixtures 509 to be off.

Figure 5B:
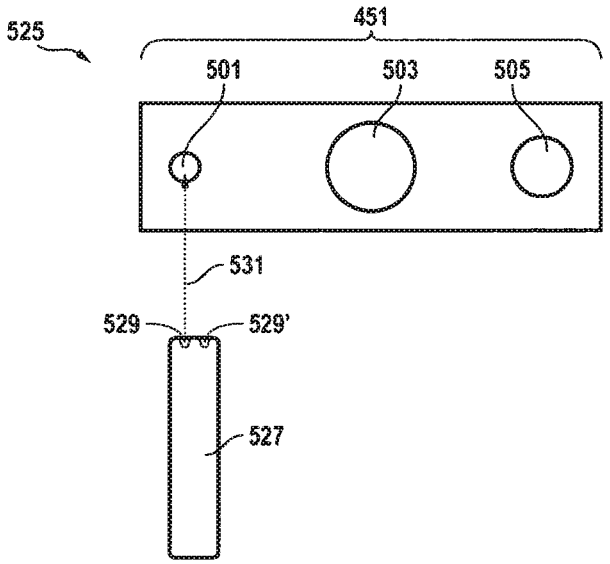
FIG. 5B shows a schematic representation of the commissioning module shown in FIG. 5A and a light source for generating visible light commissioning signals, in accordance with the embodiments of the invention.

FIG. 5B shows a schematic representation 525 of the sensor or commissioning module 451 in FIG. 5A and a hand-held light source 527 for generating visible light commissioning signals. Visible light refers to light with wavelengths between 390 and 750 nanometers, corresponding approximately to violet-blue to red light. The light sensor 501 shall be capable of reporting information about the spectral content of the visible light. For example, it may report the light intensity within specific portions of the visible spectrum. The light sensor 501 shall also differentiate and report high intensity mono-chromatic light, such as light 531 generated by the hand-held laser light source 527. Preferably, the hand-held laser light source 527 is a dual-color hand-held laser with a first laser 529 for generating laser light with a first color and a second laser 529' for generating laser light with a second color.

While the light sensor 501 described above is preferably responsive to high intensity mono-chromatic light, light sensors that are responsive to lower level visible light, such as light generated by an LED light source and/or images generated by a smart phone are also contemplated. Further, while the light sensor is preferably responsive to visible light commissioning signals with different colors, light sensors configured to be responsive to different light sequences, such as pulsed visible light commissioning signals, are also considered to be within the scope of the present invention.

Figure 6:
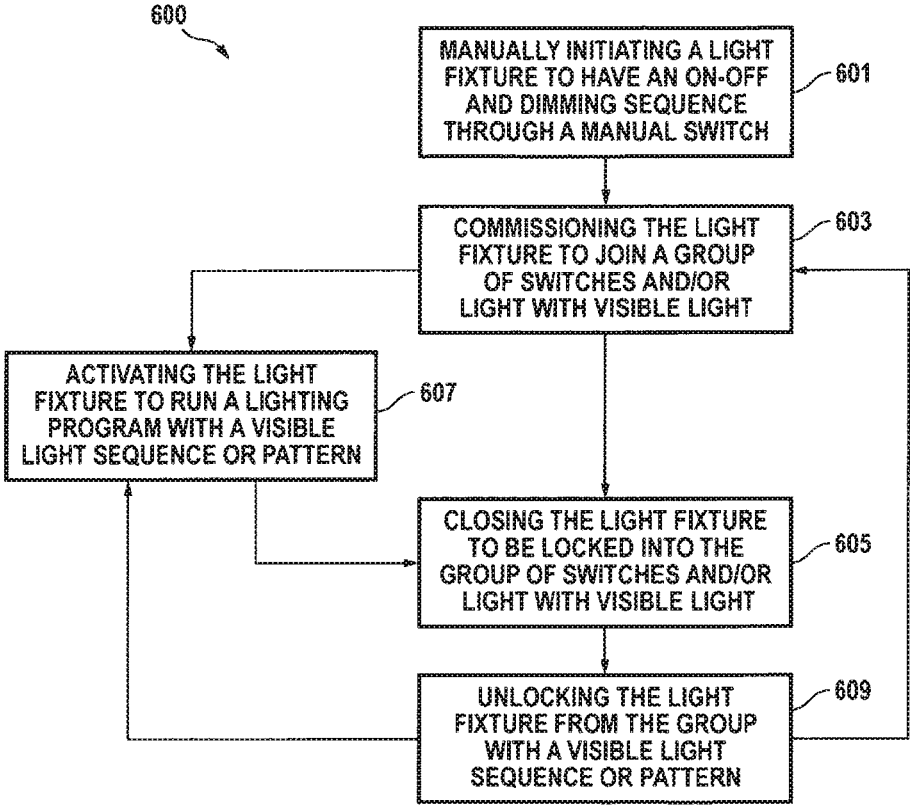
FIG. 6 shows a block-flow diagram outlining steps for commissioning lighting devices, in accordance with the method of the invention.

FIG. 6 shows a block-flow diagram 600 outlining steps for commissioning a lighting device, in accordance with a method of the invention. In a step 603, a lighting device is commissioned to create a new or join an existing group of lighting devices within a wireless lighting control network by irradiating a light sensor 501 (FIGS. 5A-B) on the lighting device with a first visible light signal from a light source, such as the dual-color hand-held laser 527 (FIG. 5B). The light sensor 501, then instructs the lighting device to join the group of lighting devices within the wireless lighting control network.

After the lighting device is commissioned to join the group of lighting devices in the step 603, then in a step 605 the lighting device is commissioned to be locked into the group and cooperatively operate with other lighting devices within the group in response to a condition by irradiating the light sensor 501 with a second visible light signal from the light source 527. Preferably, the first visible light signal and the second visible light signal have different wavelengths.

Still referring to FIG. 6, where the lighting device is a light fixture, prior to the step 603 of commissioning the device to join the group of lighting devices, in a step 601 a manual switch 505 on the commissioning module 451 is actuated. Actuating the manual switch 505 instructs the micro-processor of the controller unit 426' to run firmware to set the maximum light output and/or that places the light fixture in an on-off dimming mode, such as described in detail above.

Once the light fixture has been commissioned to join a group in the step 603 and commissioned to be locked into the group in the step 605, the light fixture can be un-locked from the group by irradiating the light sensor 501 with a visible light sequence or pattern. A step 609 of un-locking the light fixture, allows the light fixture to be re-commissioned to join a different group. The visible light sequence or pattern is, for example, a sequence of light pulses or predetermined bursts of light from the light source 527 (FIG. 5B). The sequence of light pulses or predetermined bursts of light help to provide a level of security to prevent the light fixture from accidentally be un-locked by and un-authorized person.

After the step 609 of un-locking the light fixture, or prior to the step 603 of commissioning the device to join the group of lighting devices, the lighting device is preferable capable of being commissioned to run a lighting program using a visible lighting sequence or pattern similar to that described with respect to a step 607 above.

The present invention has been described in terms of specific embodiments incorporating details to facilitate the understanding of the principles of construction and operation of the invention.

For example, while a single light sensor for sensing and responding to multiple visible light commissioning signals is disclosed, multiple light sensors with different sensitivities and/or different response to visible light commissioning signals with the same or different wavelengths is considered to be within the scope of the present invention. As such, references herein to specific embodiments and details thereof are not intended to limit the scope of the claims appended hereto. It will be apparent to those skilled in the art that modifications can be made in the embodiments chosen for illustration without departing from the spirit and scope of the invention.

What is claimed is:

1. A method of commissioning lighting devices within a wireless lighting control network, the method comprising:

irradiating a light sensor on a first lighting device with a first visible light signal from a light source, resulting in the first lighting device to create a group and broadcast group information to additional lighting devices within the wireless lighting control network;

irradiating a light sensor on one or more of the additional lighting devices within the lighting control network with a second visible light signal, thereby instructing the at least one or more of the additional lighting devices to join the group; and irradiating the light sensor on at least one of the first lighting device and the additional lighting devices with a third visible light signal thereby closing the group, such that the first lighting device and the additional lighting devices within the group cooperatively operate in response to a condition.

2. The method according to claim 1, wherein at least a portion of the lighting devices includes light fixtures and wherein a maximum light output of each of the light fixtures within the group is fixed by actuating a manual switch on one or more of the lighting devices within the group.

3. The method according to claim 1, wherein the first and the third visible light signals have different wavelengths.

4. The method according to claim 3, wherein the first, the second and the third visible light signals are generated from a hand-held laser.

5. The method according to claim 1, further comprising irradiating a light sensor on a lighting device within the group with a visible light sequence from the light source, thereby instructing the lighting devices within the group to run one or more lighting programs stored in memory units on the lighting devices.

6. The method according to claim 1, wherein the lighting devices within the group include one or more motion sensors.

7. The method according to claim 1, further comprising receiving the group information via radio transceivers on the lighting devices.

8. The method according to claim 1, wherein the first, the second and the third visible light signals are generated from a hand-held light source.

9. The method according to claim 8, wherein the hand-held light source is a light emitting diode (LED) light.

10. The method according to claim 8, wherein the hand-held light source is a smart phone.

11. The method according to claim 8, wherein the hand-held light source is a laser light.

12. The method according to claim 1, wherein broadcasting group information over the wireless lighting control network comprises actuating a momentary switch within the wireless lighting control network.

13. The method according to claim 12, wherein at least a portion of the lighting devices include light fixtures and wherein a maximum light output of each of the light fixtures within the group is fixed by actuating the momentary switch on one or more of the lighting devices within the group.

14. The method according to claim 13, further comprising irradiating a light sensor on a lighting device within the group with a visible light sequence from the light source thereby instructing the lighting devices within the group to run one or more lighting programs stored in memory units on the lighting devices.

15. A lighting system comprising:

a first light fixture, having a light engine; and a controller, the controller comprising:

a driver circuit for providing power to the light engine;

a controller circuit with a micro-processor having firmware coded for commissioning the first light fixture to cooperatively operate with a group of additional lighting devices within a wireless lighting control network; and a light sensor for receiving command signals from a first visible light source and initiating firmware from the micro-processor in response to the command signals to run and commission the first light fixture to create a group and broadcast group information to additional light fixtures within the wireless lighting control network; and one or more of the additional light fixtures, each of the additional light fixtures includes a controller with a driver circuit for providing power to the light fixture, a controller circuit with a micro-processor, a memory unit and a light sensor for receiving visible light command signals that initiate firmware from the micro-processor to commission the light fixtures having a light sensor for receiving command signals from a second visible light source and initiating firmware from the micro-processor in response to the command signals to instruct the at least one or more of the additional light fixtures to join the group, the light sensors on at least one of the first light fixtures and the at least one or more additional light fixtures further configured to receive a third visible light signal thereby closing the group, such that the first light fixture and the at least one or more additional light fixtures within the group cooperatively operate in response to a condition.

16. The lighting system according to claim 15, wherein the first light fixture further comprises a motion sensor for controlling power to the light engine based on detected motion.

17. The lighting system according to claim 15, wherein the first light fixture further comprises a manual switch for initiating firmware from the micro-processor to set a maximum light output of the first light fixture.

18. The lighting system according to claim 15, wherein the first light sensor of the first light fixture differentiates light of different wavelengths.

19. The lighting system according to claim 18, wherein a first wavelength initiates firmware from the micro-processor to run and instruct the first light fixture to cooperatively operate with the group of lighting devices and a second wavelength initiates firmware from the micro-processor to run and instruct the light fixture to be locked into the group.

20. The lighting system according to claim 15, wherein the light sensor is further responsive to receiving a light sequence from the visible light source to initiate firmware on the micro-processor to run one or more lighting programs stored on the memory unit of the first light fixture.

21. The lighting system according to claim 15, wherein the light sensor controls power to the light engine based on ambient light levels.

22. The lighting system according to claim 15, wherein the first visible light source is a hand-held light emitting diode (LED) light.

23. The lighting system according to claim 15, wherein the first visible light source is a hand-held smart phone.

24. The lighting system according to claim 15, wherein the first visible light source is a hand-held laser light.

* * * * *